US005960799A

United States Patent [19]

Suh

[11] Patent Number: 5,960,799

[45] Date of Patent: Oct. 5, 1999

[54] DEVICE FOR FORMING EYELASHES HAVING A BUILT-IN BENDING PORTION

[76] Inventor: Jeong Joo Suh, 134-2202 Olympic Apt., Bangi-dong, Songpa-ku, Seoul, Rep. of Korea

[21] Appl. No.: 09/035,012

[22] Filed: Mar. 5, 1998

[30] Foreign Application Priority Data

Sep. 10, 1997 [KR] Rep. of Korea ..... 97/25654
Feb. 4, 1998 [KR] Rep. of Korea ..... 98/1170

[51] Int. Cl.[6] ..... A45D 2/48; A45D 40/30

[52] U.S. Cl. ..... 132/217; 132/216

[58] Field of Search ..... 132/217, 216, 132/218, 213, 223

[56] References Cited

U.S. PATENT DOCUMENTS

| | | | |
|---|---|---|---|
| 918,435 | 2/1909 | Tradou | 132/217 |
| 2,004,046 | 6/1935 | Gaser et al. | 132/217 |
| 2,168,370 | 8/1939 | Solomon | 132/217 |
| 2,392,694 | 1/1946 | Rector | 132/217 |
| 2,565,541 | 8/1951 | Wolff | 132/217 |
| 3,640,290 | 2/1972 | Theis | 132/217 |
| 5,524,649 | 6/1996 | Suh | 132/217 |
| 5,685,324 | 11/1997 | Huang | 132/217 |

*Primary Examiner*—John J. Wilson
*Assistant Examiner*—Trang Doan

[57] ABSTRACT

A device for shaping eyelashes which comprises a handle, a main eyelash-shaping device attached to one end portion of the handle, said main eyelash-shaping device containing a support pad and a support member and means for moving the support pad relative to the support member for compressing an eyelash therebetween, and an auxiliary eyelash-shaping device operatively connected to the other end portion of the handle, said auxiliary eyelash-shaping device containing a head portion which extends into an auxiliary knob, said head portion being rotatably coupled to an extension arm for defining opposing jaws which close on each other, whereby portions of an eyelash can be shaped by moving the auxiliary knob to compress the eyelash between said jaws.

3 Claims, 3 Drawing Sheets

DEVICE FOR FORMING EYELASHES HAVING A BUILT-IN BENDING PORTION

BACKGROUND OF THE INVENTION

1. Field of the Invention

The present invention relates to a device for forming eyelashes upwardly and, more particularly, to an eyelash-forming device having an auxiliary bending portion integrally provided in a knob and including a pressure part, a support pad and a spring for supporting the pressure part and for forming both end portions of the eyelashes in a more effective manner.

2. Discussion of the Related Art

A typical device for forming eyelashes in an upward manner to make a woman more beautiful has a scissors-like shape. The device is operated by inserting both the thumb and the index finger into knobs to pressurize the pressure pad. another example of a conventional device for forming eyelashes developed by the applicant of the present invention is disclosed in Korean Utility Model Application No. 96-571 and U.S. Pat. No. 5,524,649, which uses a lever provided on knobs for applying a force to the pressure pad.

However, a survey of consumer's complaints for devices for forming eyelashes as described above have revealed that the device is not effective in forming or shaping both end portions of the eyelashes in the upward direction.

Therefore, the present invention has been made to overcome the disadvantages of the conventional eyelash forming devices.

SUMMARY OF THE INVENTION

Accordingly, the present invention is directed to a device for forming eyelashes that substantially obviates one or more of the problems found in the related art.

An object of the present invention is to provide a device for forming eyelashes in an upward direction which has an auxiliary bending portion integrally provided in a knob for more effectively forming the eyelashes.

Additional features and advantages of the present invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a device is provided for shaping eyelashes utilizing an auxiliary bending portion integrally provided in a knob. When pressing a pressure portion, a support spring is compressed to push a support pad towards a support member with an actuating member attached to the support member, thereby effecting the entire eyelash curling operation. The device has a compact structure including a built-in partial forming portion and is convenient in shaping both end portions of the eyelashes in the upward direction.

Different from the conventional eyelash forming device, the present invention is designed to have the partial forming part provided in the knob in the rear portion of the conventional device and can be taken out as necessary for convenient use.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF PREFERRED EMBODIMENT

Reference will now be made in detail to the preferred embodiments of the present invention, examples of which are illustrated in the accompanying drawings.

Figure 1:
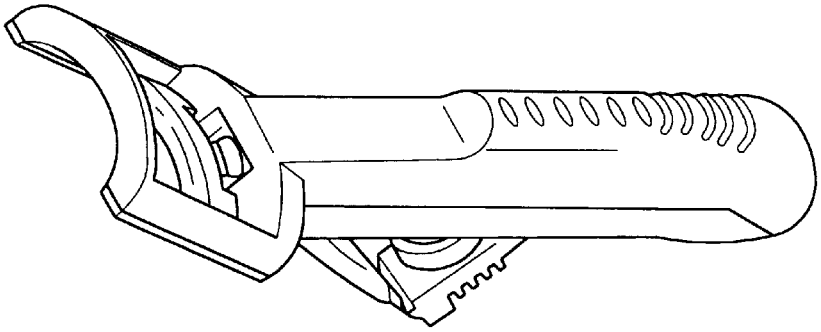
FIG. 1 is a perspective view of a conventional device for forming eyelashes.
Figure 2:
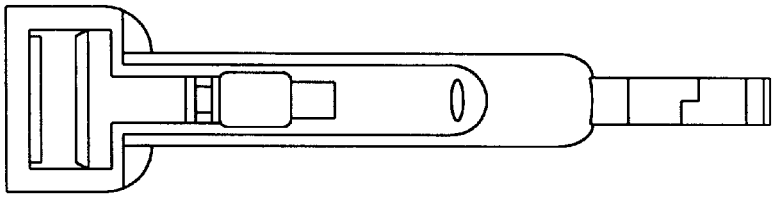
FIG. 2 is a top view of a device for forming eyelashes in accordance with a preferred embodiment of the present invention.
Figure 3:
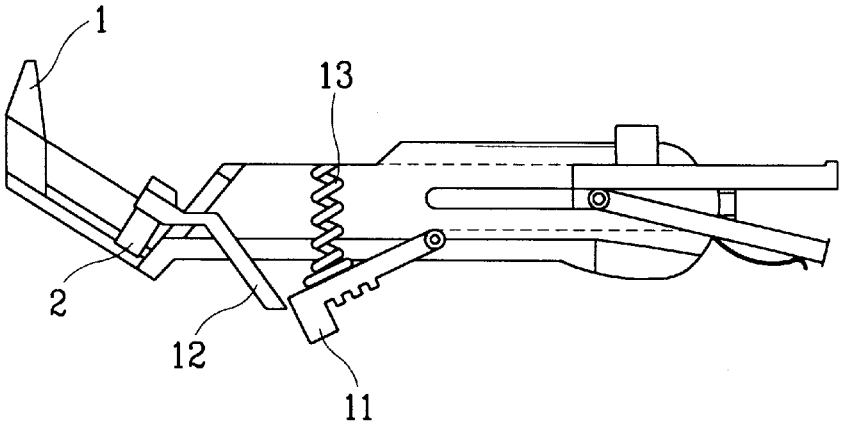
FIG. 3 is a cross-sectional view showing the operation of a conventional eyelash forming device.
Figure 4:
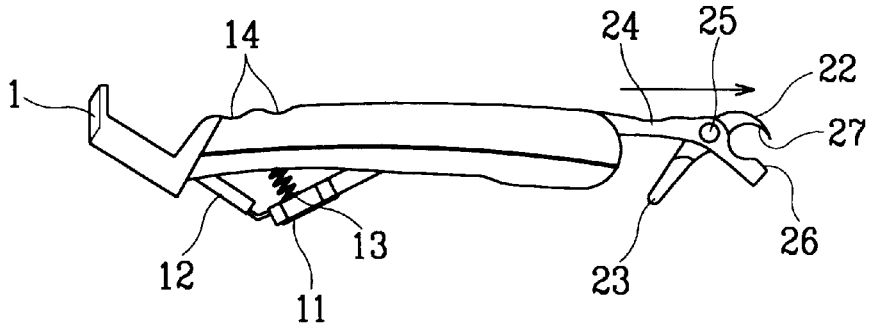
FIG. 4 is a view showing the operation of the auxiliary eyelash forming portion of the device according to the present invention.

As shown in FIG. 4< a device for shaping the main portion of the eyelashes has a pressure element 11, a spring 13 for biasing the pressure element 11, a support pad 12, a support member 1, and an actuating member 2. When the pressure element 11 is pressed to compress the spring 13, the support pad 12 moves the actuating member 2 up towards the support member 1, shaping the eyelash between members 1 and 2. This portion of the device is constructed to shape the entire eyelash in one step. The device also includes a finger pad 14 on a knob to support fingers when pressing the pressure element 11 for more convenient use. Advantageously, and according to the present invention, an auxiliary eyelash shaping system is provided to treat both end portions of the eyelashes more effectively than the prior art devices.

Figure 5:
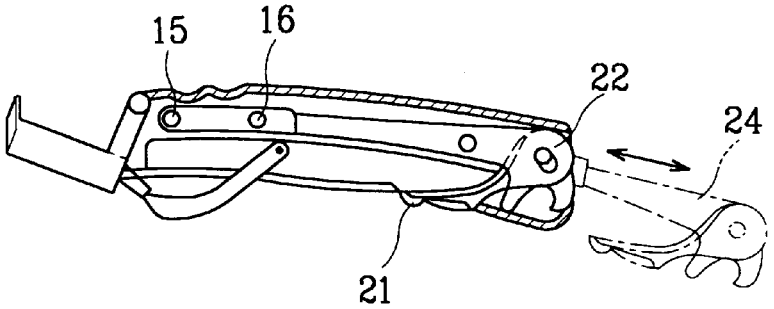
FIG. 5 is a cross-sectional view showing the operation of the device of FIG. 4.
Figure 6:
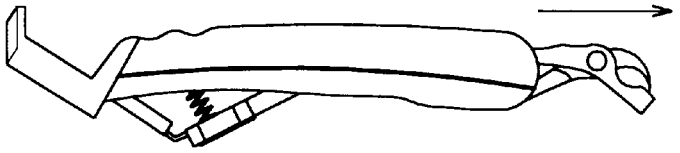
FIG. 6 is a view showing the device as shown in FIG. 4 before operation.
Figure 7:
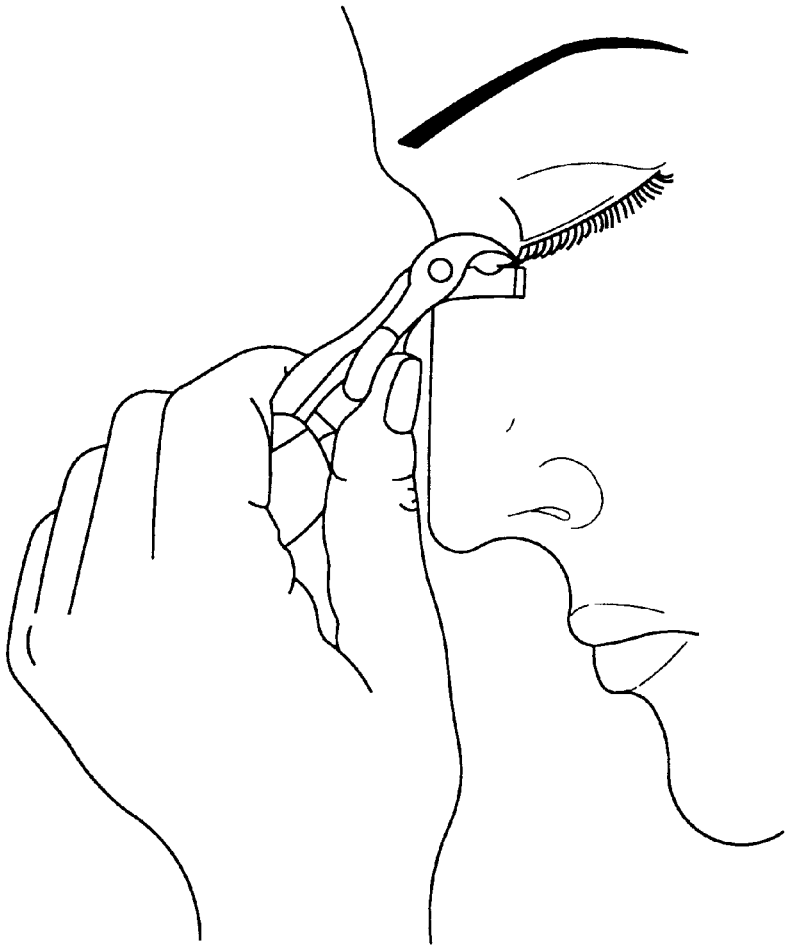
FIG. 7 is a view showing the use of the eyelash forming device of the present invention in forming the end portion of the eyelashes

As shown in FIG. 5, the auxiliary eyelash shaping system is built in the knob and is operated by pressing the push-in bar 21. Referring to FIG. 6, when the push-in bar 21 is pressed< the auxiliary eyelash shaping system having a head 22, which is also used as an opening part, extends outwardly from inside the fixing part 15. An auxiliary knob 23 is mounted on the head of the auxiliary forming part 22 via a coupling shaft 25 provided with a built-in support spring. The auxiliary forming head part 22 is made up of an auxiliary forming pad 27 and a silicon part 26.

As shown in FIG. 4, when the auxiliary knob 23, which is connected to element 24 which in turn is fixed to an inwardly extending fixing element 16, is compressed to shape the eyelash, the auxiliary forming pad 27 passes the eyelash against the silicon portion 26 in the downward direction whereby both end portions of the eyelashes can be shaped in a more effective manner.

At this stage, the angle formed by the auxiliary forming pad 27 and the silicon portion 26 is preferably about 45° and adjusted automatically to a desired angle by the aid of the auxiliary knob 23 and the coupling shaft 25 having a built-in support spring.

After the partial shaping of the eyelashes, the auxiliary knob 23 is compressed to move the auxiliary eyelash shaping portion into the knob, whereby the partial forming part 24 is released from the inwardly extending fixing element 16 and fastened to the inside fixing element 15. Thus the partial forming element 24 can be integrally built in the knob of the eyelash forming device of the present invention.

As described above, the device for forming eyelashes in accordance with the present invention includes the auxiliary forming part used to form both end portions of eyelashes more perfectly after the entire formation of eyelashes without using additional eyelash forming device. Accordingly, the present invention presents more advantages than the prior art in the aspect of size, cost and convenient use.

Since the above embodiments are described only for examples, the present invention is not limited to the above embodiments and various modifications or alterations can be easily made therefrom by those skilled in the art without departing from the scope of the present invention.

What is claimed is:

1. A device for shaping eyelashes which comprises a handle, a main eyelash-shaping device attached to one end portion of the handle, said main eyelash-shaping device containing a support pad and a support member and means for moving the support pad relative to the support member for compressing an eyelash therebetween, and an auxiliary eyelash-shaping device operatively connected to the other end portion of the handle, said auxiliary eyelash-shaping device containing a head portion which extends into an auxiliary knob, said head portion being rotatably coupled to an extension arm for defining opposing jaws which close on each other, whereby portions of an eyelash can be shaped by moving the auxiliary knob to compress the eyelash between said jaws.

2. The device of claim 1, wherein means are provided for moving the auxiliary eyelash-shaping device into the handle or extending the auxiliary eyelash-shaping device from the handle.

3. The device of claim 1, wherein the opposing jaws contain an auxiliary forming pad and a silicon portion.

* * * * *